US005316287A

United States Patent [19]

Hiroi et al.

[11] Patent Number: 5,316,287

[45] Date of Patent: May 31, 1994

[54] TRAY APPARATUS

[75] Inventors: Masakazu Hiroi, Tokyo; Akimitsu Hoshi, Yokohama; Noriyoshi Iida, Ichikawa; Tadayuki Kitajima; Nobutaka Uto, both of Yokohama, all of Japan

[73] Assignee: Canon Kabushiki Kaisha, Tokyo, Japan

[21] Appl. No.: 988,879

[22] Filed: Dec. 10, 1992

Related U.S. Application Data

[60] Division of Ser. No. 758,484, Sep. 9, 1991, Pat. No. 5,215,300, which is a continuation of Ser. No. 277,523, Nov. 28, 1988, abandoned, which is a continuation of Ser. No. 839,610, Mar. 14, 1986, abandoned.

[30] Foreign Application Priority Data

| | | | |
|---|---|---|---|
| Mar. 15, 1985 | [JP] | Japan | 60-053065 |
| Mar. 18, 1985 | [JP] | Japan | 60-055485 |
| Mar. 20, 1985 | [JP] | Japan | 60-057141 |

[51] Int. Cl.[5] ..... B65H 31/04

[52] U.S. Cl. ..... 271/213; 271/217

[58] Field of Search ..... 271/213-215, 271/217, 320; 414/788.9, 791.2, 792.5, 792.8, 793.8

[56] References Cited

U.S. PATENT DOCUMENTS

| | | | |
|---|---|---|---|
| 3,847,388 | 11/1974 | Lynch | 271/220 |
| 3,907,276 | 9/1975 | Gerbasi | 271/184 |
| 3,968,364 | 7/1976 | Miller . | |
| 4,012,036 | 3/1977 | Sokol | 271/214 |
| 4,058,359 | 11/1977 | Urselmann . | |
| 4,229,650 | 10/1980 | Takahashi et al. . | |
| 4,334,759 | 6/1982 | Clausing . | |
| 4,350,333 | 9/1982 | Landa | 271/217 |
| 4,509,739 | 4/1985 | Kurokawa | 271/176 |
| 4,569,514 | 2/1986 | Holtje | 271/314 |
| 4,717,134 | 1/1988 | Iida et al. | 270/39 |

FOREIGN PATENT DOCUMENTS

| | | | |
|---|---|---|---|
| 1243966 | 7/1967 | Fed. Rep. of Germany . | |
| 52-152381 | 12/1977 | Japan . | |
| 53-15915 | 2/1978 | Japan . | |
| 54-29481 | 3/1979 | Japan . | |
| 54-128280 | 9/1979 | Japan . | |
| 57-48558 | 3/1982 | Japan . | |
| 57-77158 | 5/1982 | Japan . | |
| 58-52140 | 3/1983 | Japan . | |
| 59-102761 | 6/1984 | Japan . | |
| 59-118659 | 7/1984 | Japan | 271/213 |
| 59-149264 | 8/1984 | Japan . | |
| 59-219760 | 12/1984 | Japan . | |
| 60-31463 | 2/1985 | Japan . | |
| 61-206769 | 9/1986 | Japan . | |
| 1248845 | 10/1989 | Japan . | |
| 988561 | 12/1963 | United Kingdom . | |

OTHER PUBLICATIONS

"IBM Technical Disclosure Bulletin", vol. 17, No. 8, p. 2255, Jan. 1975, Sheet Stacking Technique, D. F. Manning and J. V. Vetrone.

*Primary Examiner*—David H. Bollinger

*Attorney, Agent, or Firm*—Fitzpatrick, Cella, Harper & Scinto

[57] ABSTRACT

A sheet stacking tray apparatus for receiving sheets discharged from an image forming apparatus such as a printer or copying machine. The sheets are correctly stacked, that is, without inclination or deviation. The tray apparatus according to the present invention is such that the speed at which the sheet is discharged to the tray apparatus is reduced when the tray apparatus receives the sheet material. And, the sheet is laterally shifted so as to correct the lateral deviation thereof. The tray is lowered in accordance with the amount of the sheets so as to keep a proper height thereof with respect to the discharging outlet from which it receives the sheet. An auxiliary sheet stacking plate is provided operable in association with the lowering of the tray so as to raise the sheet receiving side thereof so as to keep the sheet material on the tray horizontal.

7 Claims, 12 Drawing Sheets

TRAY APPARATUS

This application is a division of application Ser. No. 07/758,484 filed Sep. 9, 1991, now U.S. Pat. No. 5,215,300; which of application Ser. No. 07/277,523 filed Nov. 28, 1988, now abandoned; which is a continuation of parent application Ser. No. 07/839,610 filed Mar. 14, 1986, now abandoned.

FIELD OF THE INVENTION AND RELATED ART

The present invention relates to a tray apparatus for stacking sheet materials, which will be hereinafter called simply "sheets", discharged from an image forming apparatus such as a printer and copying machine.

In order to align the sheets on a discharge tray, it is conventional that limiting members be mounted adjacent lateral (with respect to the direction of transportation of the sheet) sides to align the sheet in the lateral direction; or that a limiting member is mounted adjacent one lateral side, and the sheet is laterally moved to abut the limiting member by an inclined roller, an inclined guide, a rotary paddle, a rotary brush and orthogonal rollers as an auxiliary member for the lateral alignment. This, however, results in a complicated structure of the tray itself because the above-mentioned mechanism is mounted on the tray, or it is necessary to cover the entire tray.

In a conventional tray apparatus having a classification function, it is shiftable in the lateral direction and has a tray member disposed a predetermined distance below the sheet discharging opening for discharging the sheet to the tray and inclined upwardly toward the outside. The sheets discharged through the sheet discharging outlet fall on the laterally shiftable tray. The trailing edges of the sheets are aligned by abutting a sheet stopper and stacked on the tray in the classified state.

However, the height of the sheets stacked on the tray increases with the number of the sheets stacked thereon. For example, the height through which the first sheet falls onto the tray is significantly different from the height through which the 200th, for example, sheet falls onto the then topmost sheet of the stacked sheets. Since the sheet can deviate laterally when the received sheet slides on the topmost sheet back to the sheet stopper, the amount of lateral movement of the sheet is different depending on the number of sheets stacked on the tray. This results in that the top portion of the stack of the sheets are aligned, but many of the lower sheets thereof are not aligned.

It has been proposed that the sheet stopper be provided with a rubber cushion fixed thereto to prevent the deviation of the sheet due to the rebound of the sheet abutting the stopper. However, it has been found that this reduces only slightly the degree of deviation, but does not satisfactorily align the lower part of the sheets on the tray.

Further, there is a problem in the device of the type wherein the tray is laterally shiftable, that is, the stacked sheets do not move with the lateral movement of the tray due to the contact with the sheet stopper, when the height of the stack of the sheets on the tray increases.

It is also conventional that a sheet folding apparatus is disposed upstream of the tray apparatus so that the tray apparatus receives a folded sheet, for example, a z-folded sheet. When a number of z-folded sheets are stacked, only the three-folded part of the stack becomes high, with the result that the newly discharged sheet abuts this part, whereby the sheets already aligned and stacked are disturbed, or whereby the newly discharged sheet is significantly inclined.

SUMMARY OF THE INVENTION

Accordingly, it is a principal object of the present invention to provide a tray apparatus wherein the sheets are satisfactorily aligned (without unsatisfactory inclination and deviation).

It is a further object of the present invention to provide a tray apparatus wherein no complicated aligning mechanism is mounted on the tray.

According to an embodiment of the present invention, the inclination of the sheet is corrected prior to the sheet being discharged to the tray apparatus, and a lateral edge thereof is aligned with a reference line, whereby the discharged sheet is discharged at a constant lateral position, thus eliminating the deviation of the sheet up to this point of time. Therefore, the sheets are stacked on the tray at the correct position.

Further, the speed of the sheet discharging by the discharging roller is reduced as compared with the conveying speed of the sheet advancing rollers of the image forming apparatus or the sheet folding apparatus. By this, the influence is reduced which is given by the air existing from the level of the discharging sheet to the top surface of tray, so that the disturbance to the sheet is reduced to improve the lateral alignment of the sheet. Therefore, the sheet is further correctly aligned and stacked on the tray.

According to an embodiment of the present invention, the tray is shifted vertically depending on the height of the stack on the tray, whereby the falling distance of the discharged sheet can be maintained substantially constant since the tray shifts vertically depending on the height of the stacked sheets.

In addition, the amount of the sheets stacked on the tray can be significantly increased.

According to an embodiment of the present invention, the sheet stopper is laterally reciprocally shiftable together with the tray, whereby the tray and the sheet stopper are movable as a unit in a horizontal plane. Then, the trailing edges of the sheets do not influence the lateral reciprocation of the tray, and therefore, the sheets can be correctly classified even when the amount of the sheets stacked thereon is increased. Thus, the sheets are correctly stacked on the tray.

The tray apparatus according to an embodiment of the present invention has a tray inclined upwardly toward the outside or away from the image forming apparatus, wherein the tray has an auxiliary sheet stacking portion which inclines in the opposite direction. Because of this, when the sheet is discharged to the tray, the auxiliary sheet stacking plate is inclined oppositely depending on the height of the stack of the sheets, so that a number of sheets are stably stacked on the surface provided by the tray and the auxiliary sheet stacking plate. Therefore, the sheets are stacked correctly on the tray.

Particularly, when z-folded sheets are stacked, for example, the auxiliary sheet stacking plate is inclined in the opposite direction depending on the height of the stack of the z-folded sheet. Even if a number of z-folded sheets are stacked, the larger height portion of the three-folded sheets can be accommodated. Thus, a number of the z-folded sheets can be stably stacked on the surface formed by the sheet stacking tray and the auxiliary sheet stacking plate. Therefore, the newly discharged sheet is prevented from contacting or abutting the higher portion of the stack of the z-folded sheet. Furthermore, the discharged sheet does not incline. Accordingly, the z-folded sheets are stacked correctly on the tray.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
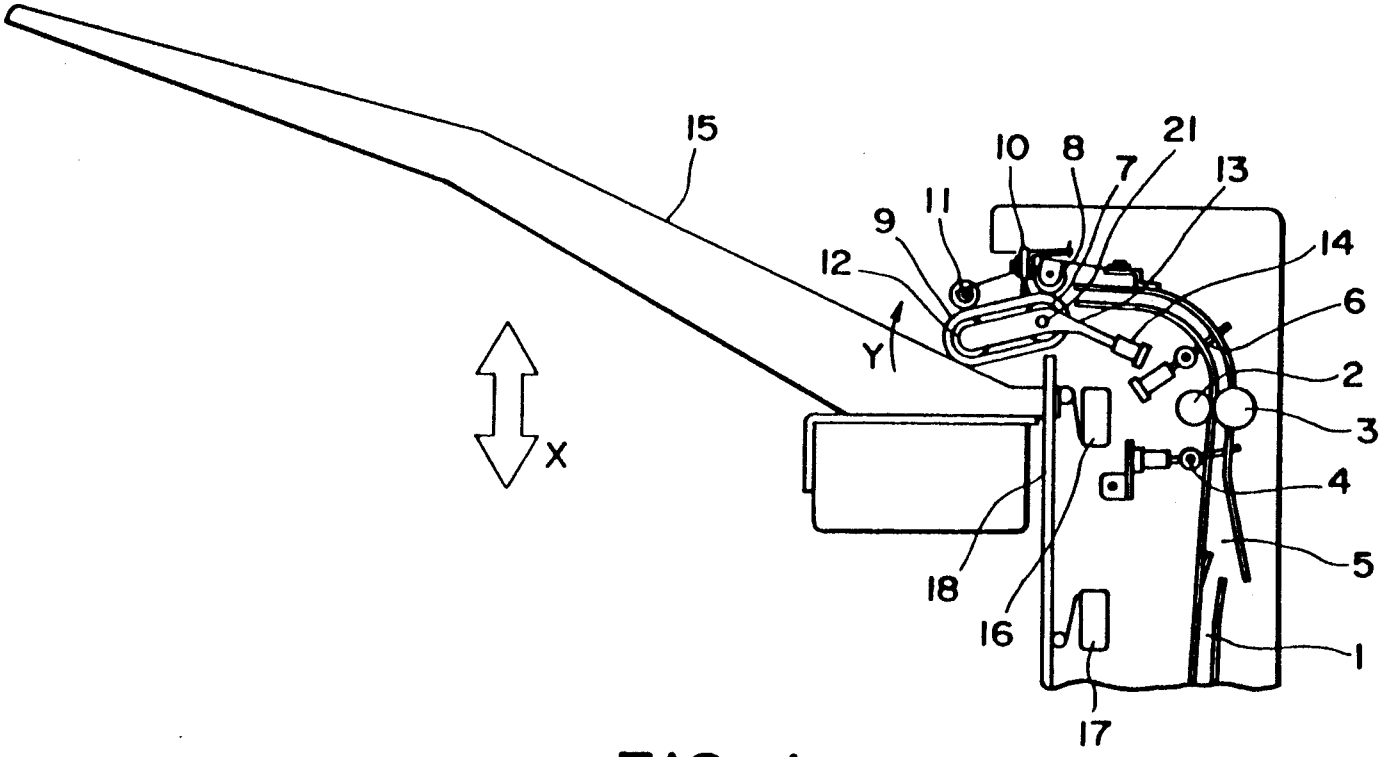
FIGS. 1 and 2 are sectional views of a discharging portion of a tray apparatus according to an embodiment of the present invention.
Figure 2:
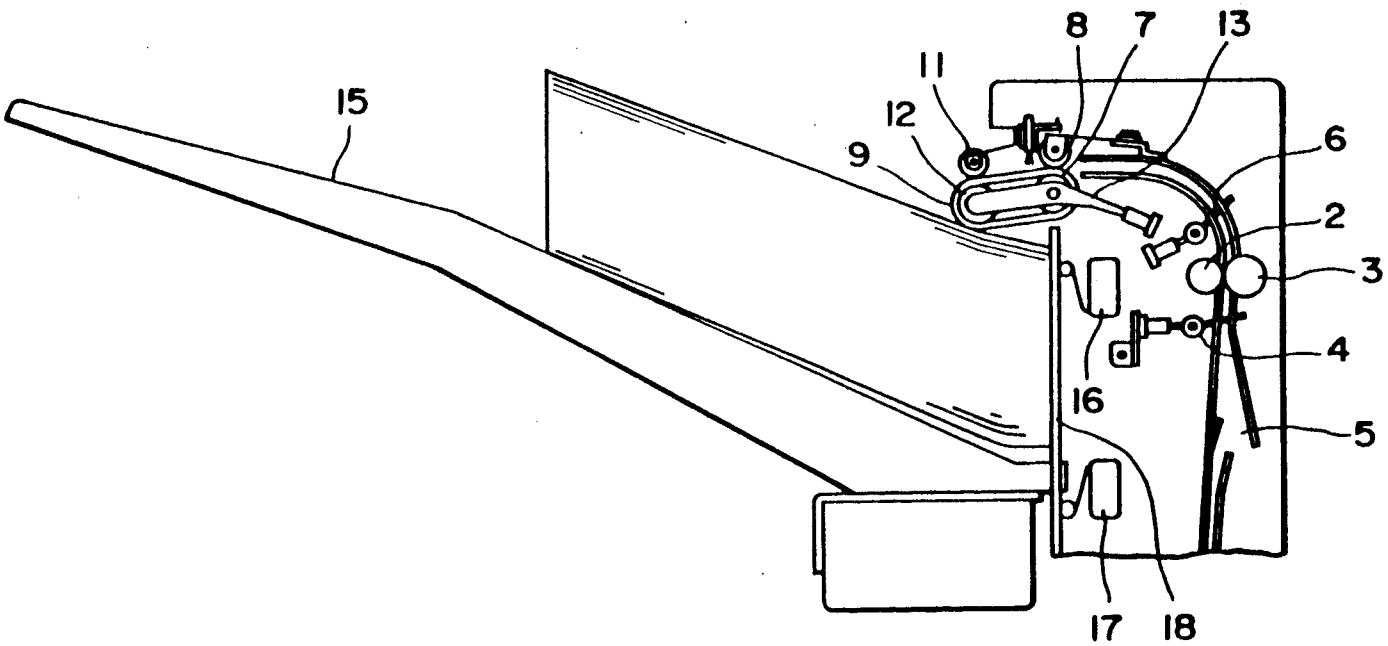

Referring to FIG. 1, there is shown a tray apparatus according to an embodiment of the present invention. This tray apparatus may be used with a copying apparatus or other image forming apparatus, thus constituting an entire image forming system. The image forming apparatus may include a known image forming means such as a charger, image exposure means and developing means and so on.

Figure 5:
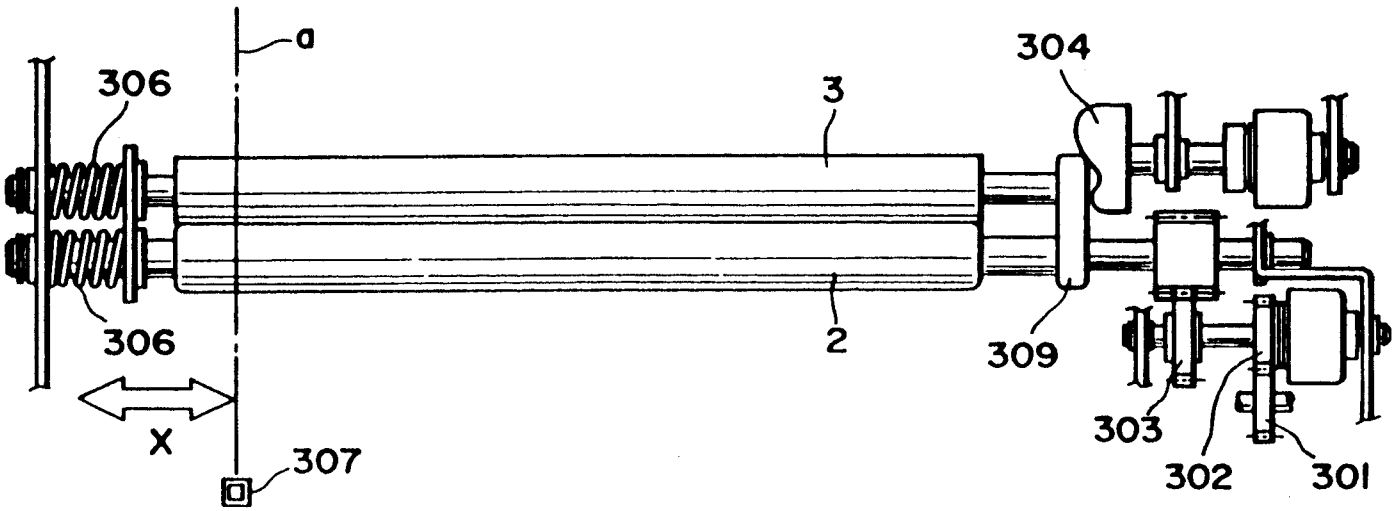
FIGS. 5 and 6 are plan views illustrating a drive mechanism for a registeration roller and a lateral moving mechanism.

A copy sheet discharged from an unshown image forming apparatus such as a copying machine is conveyed by unshown conveying rollers provided at an inlet of the tray apparatus into a vertical passage 1. In the passage 1, there is provided a couple of registration rollers 2 and 3. The surface of the roller 2 is of a rubber material, while the surface of the other roller 3 is of a metal or a resin. The registration roller couple is driven through a clutch as shown in FIG. 5 which will be described in detail hereinafter. A registration sensor 4 is provided to detect the leading edge of the sheet material. In response to the detection by the registration sensor 4, the clutch for the registration roller is engaged or disengaged. The portion indicated by a reference numeral 5 is a space for forming a loop of the sheet material, which will be hereinafter called "loop space", which is defined by a part of the passage plate cut and gently bent away from the passage shown in this Figure to expand the passage space.

A transmission control sensor 6 is disposed at a position shown in FIG. 1 and is effective to change the peripheral speed of discharging rollers in two stages by a mechanism shown in FIG. 4 which will be described hereinafter. The transmission control sensor 6 also functions as a discharge sensor for the sheet material in this embodiment. Designated by reference numerals 7 and 8 are a discharging roller (a tension roller) and a pressing roller, respectively. They serve to discharge the sheet material onto the alignment tray 15. The pressing roller 8 is contacted to a belt 9 which is effective to align the sheets and is trained around the discharging roller 7 and a tension roller 12. When the sheet material is discharged onto the alignment tray 15, the belt serves to move the discharged sheet to the alignment tray 15 so that the edge thereof forcibly abuts a stopper 18, thus aligning it in the direction of sheet transportation.

The alignment tray 15 is movable by an unshown driving source in the direction indicated by an arrow X, and its reciprocable range is limited by the upper limit microswitch 16 and the lower limit microswitch 17. A level detecting arm 13 connects the discharging roller 7, the tension roller 12 and the photointerruptor 14 for detecting the stack thickness, and is rotatable in the direction indicated by an arrow Y. Therefore, when the copy sheets are continuously stacked with the result of the increased thickness of the stack, the level detecting arm 13 rotates in the direction of the arrow Y to actuate the photointerruptor 14, and in response thereto, the alignment tray 15 shifts downwardly by the amount of the stack thickness increase.

In operation, the sheet material reaching the vertical passage 1 rotates the registration sensor 4, by which the timer circuit is energized. Then, the leading edge of the sheet is stopped at the nip between the registration rollers 2 and 3, which do not rotate at this time. A predetermined period after the leading edge of the sheet passes by the registration sensor 4, that is, after a proper loop of the sheet is formed in the loop space 5, and the registration is thus completed; and, the registration rollers 2 and 3 start rotating by the driving system as shown in FIG. 5 which will be described hereinafter. Upon or immediately after start of the registration rollers 2 and 3, the registration rollers 2 and 3 move in the lateral direction. This lateral movement continues while the registration rollers 2 and 3 are rotating, until the lateral edge of the sheet is correctly positioned at a discharge reference line a. This lateral movement is provided by rotation of a cam shown in FIG. 5 which will be described hereinafter. In order to detect the position of the lateral edge of the sheet with respect to the reference line a, a sensor such as a photointerruptor is disposed on the reference line a.

By those steps described above, the inclination of the sheet is corrected, and the lateral discharging position of the sheet is regulated. When the transmission control sensor 6 detects the leading edge of the sheet, the peripheral speed of the discharging roller 7 is controlled by a mechanism shown in FIG. 4 which will be described hereinafter, so that the peripheral speed is substantially equal to that of the registration rollers 2 and 3. In this embodiment, the transmission is of two-shifts type, and the higher speed is selected at this time, so that the sheet is discharged at a higher speed onto the tray. When the trailing edge of the sheet is detected by the transmission control sensor 6, the speed is restored to be lower than the speed of the sheet conveying system, whereby the sheet is discharged onto the alignment tray 15 at a sufficiently reduced speed.

Figure 3:
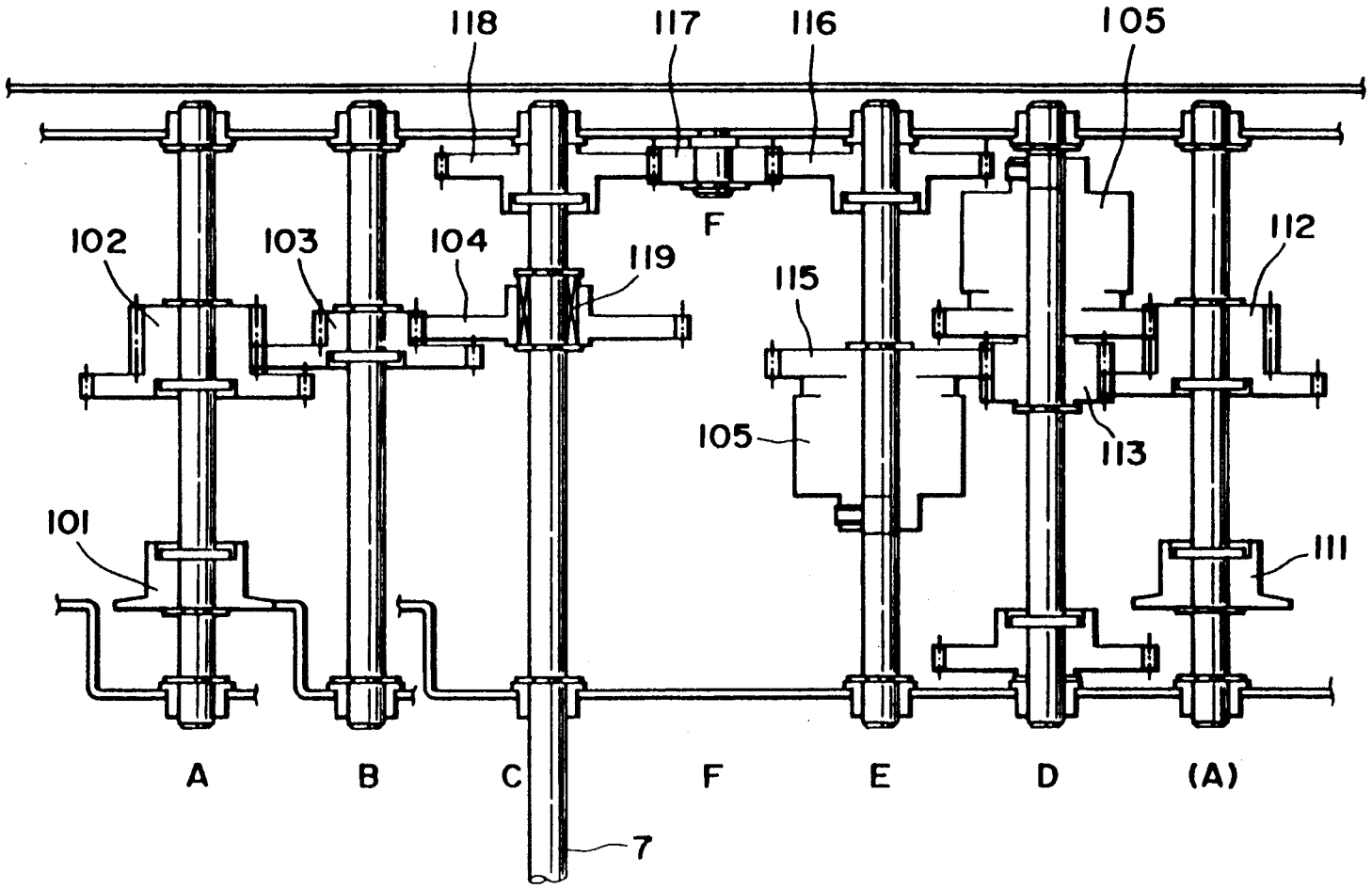
FIG. 3 is a plan view of a drive transmission mechanism.

FIG. 3 illustrates a transmission mechanism in this embodiment, wherein gear train shafts A, B, C, D, E and F are shown, which enables two-speed switchover transmission. The shaft C corresponds to the discharging roller 7 of FIG. 1. This mechanism is not contained in FIG. 1, but it is understood that the mechanism is within the alignment tray apparatus. The drive of the motor is transmitted to the pulley 101 through a timing belt to rotate the shaft A. In the normal state, the driving force is transmitted through the gear train 102 and the gear train 103 with reduction of the speed, and then transmitted to a one way gear 104, whereby the discharging roller shaft is rotated at the lower one of the speeds. When the transmission control sensor 6 detects the leading edge of the sheet, the clutches 105 are energized with the result that the discharging roller shaft is rotated at a higher one of the two speeds through the transmission path A-D-E-F-C. More particularly, the pulley 111 of the shaft A is drivingly connected by the belt so that it normally rotates. When the clutches 104 and 105 are engaged, the shaft 7 rotates by way of the gears 112, 113, 115, 116, 117 and 118. Since the gear 104 and the shaft 7 are frictionally engaged the shaft 7 is permitted to rotate at a high speed even when the gear 104 rotates. When the trailing edge of the sheet is detected by the transmission control sensor 6, the clutches 105 are disengaged, whereby the discharging roller shaft rotates at the lower speed again through the drive force transmitting path A-B-C.

At this time, the speed of the sheet is decreased while the trailing edge portion of the sheet 7 is gripped by the discharging roller couple 7.

Figure 4:
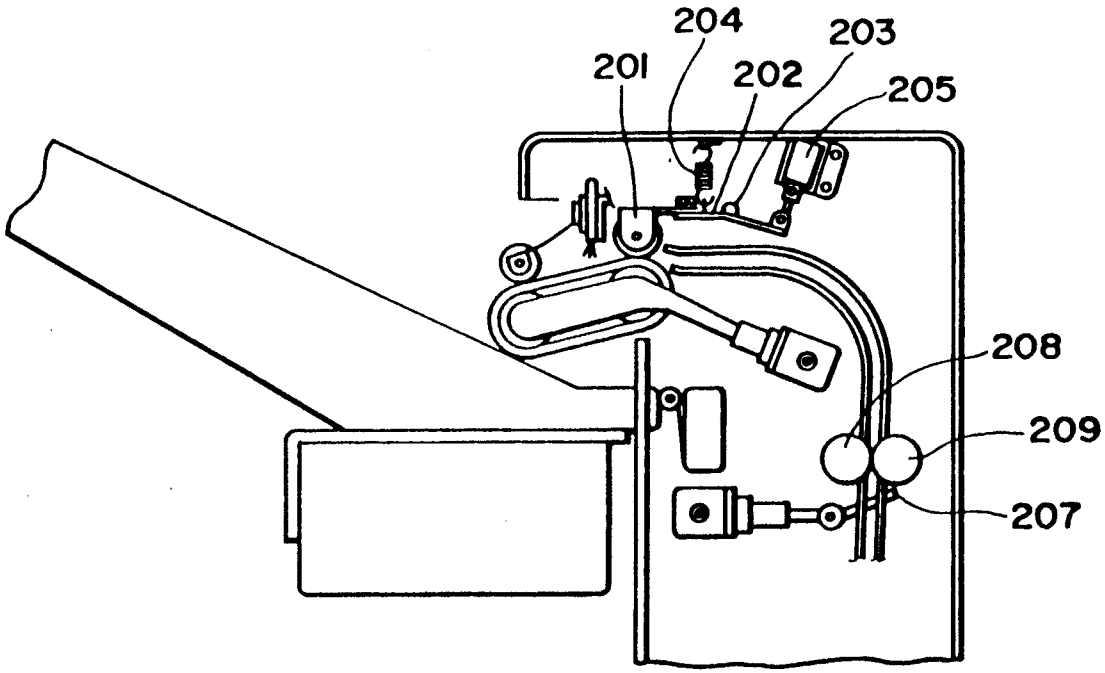
FIG. 4 is a sectional view of a portion of a tray apparatus according to another embodiment of the present invention to illustrate another example of the drive transmission mechanism.

FIG. 4 is an another example of the mechanism for decreasing the speed while the sheet is being discharged. Conveying rollers 208 and 209 always rotate at a constant rotational speed to convey the sheet. Designated by the reference numeral 207 is a sheet sensor. A discharge-pressing roller 201 is mounted on a releasing arm 202 by screws and rotatable about a rotational axis 203. A solenoid 205 receives a signal from a sheet sensor 207, and in response thereto, it is energized and deenergized. In this embodiment, when the solenoid is energized, the pressing roller 201 is pressed to the discharging roller as shown in FIG. 4. When the sheet is conveyed by the conveying rollers 208 and 209, the solenoid 205 is deenergized, so that the discharging roller and the pressing roller 201 are spaced apart by the force of a spring 204. The sheet conveying speed is determined by the conveying rollers 208 and 209. When the trailing edge of the sheet passes by the sheet sensor 207, the solenoid is energized, and the pressing roller 201 is pressed to the discharging roller. Then, the speed of the sheet is determined by the peripheral speed of the discharging roller. The peripheral speed of the discharging roller is so determined as to be lower than that of the conveying rollers 208 and 209, and therefore, the two stage switching of the conveying speed. The speed of the discharging roller couple may be decreased prior to start of the discharging action to the sheet. What is required is that the speed of the sheet is low at least at the instance of being discharged.

FIG. 5 illustrates operation of the registration rollers 2 and 3, wherein the registration rollers are indicated by the reference numerals 2 and 3. The registration rollers 2 and 3 are driven by an unshown driving source through a gear 301, an electromagnetic clutch 302 and a gear 303. In this embodiment, the registration roller 2 is directly driven. The electromagnetic clutch 302 serves to transmit or disconnect the driving power. When the leading edge of the sheet reaches the nip between the registration rollers 2 and 3, and a loop of the sheet is formed. When the electromagnetic clutch 302 is energized in this state, the registration rollers 2 and 3 start rotating to grip and convey the sheet. At the time when the transmission controlling sensor 5 detects the leading edge of the sheet, a cam 304 starts rotating to move a cam follower plate 309, whereby the registration rollers 2 and 3 shift in the direction of X in FIG. 5 so as to align a lateral edge of the sheet with the reference line a. When the lateral edge of the sheet is aligned with the lateral reference line a, the cam 304 stops, and therefore, the cam follower plate 309 stops. The control of this stop is effected using a sensor 307 such as a photointerruptor disposed on the lateral reference line. With this structure, the inclination of the sheet is corrected, and the variation of the discharging position can almost be removed. The registration rollers 2 and 3 are restored by rotating again the cam 304 to which the follower plate 309 is urged by the spring 306.

Figure 6:
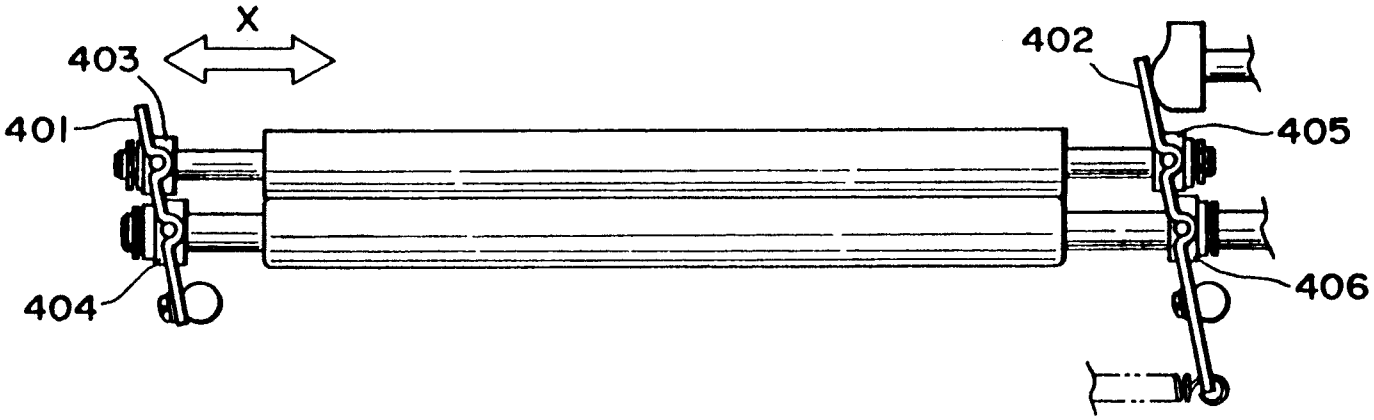

FIG. 6 illustrates another mechanism for laterally shifting the registration rollers. The transmission of the driving power is the same as with the FIG. 5 embodiment. In this embodiment, the lateral shifting is effected by a cam, pivotable follower arms 401 and 402 and bearings 403, 404, 405 and 406 rotatably supported on the follower plates 401 and 402 as shown in FIG. 6. It will be understood that lateral shifting similar to that of FIG. 5 embodiment can be accomplished.

Figure 9:
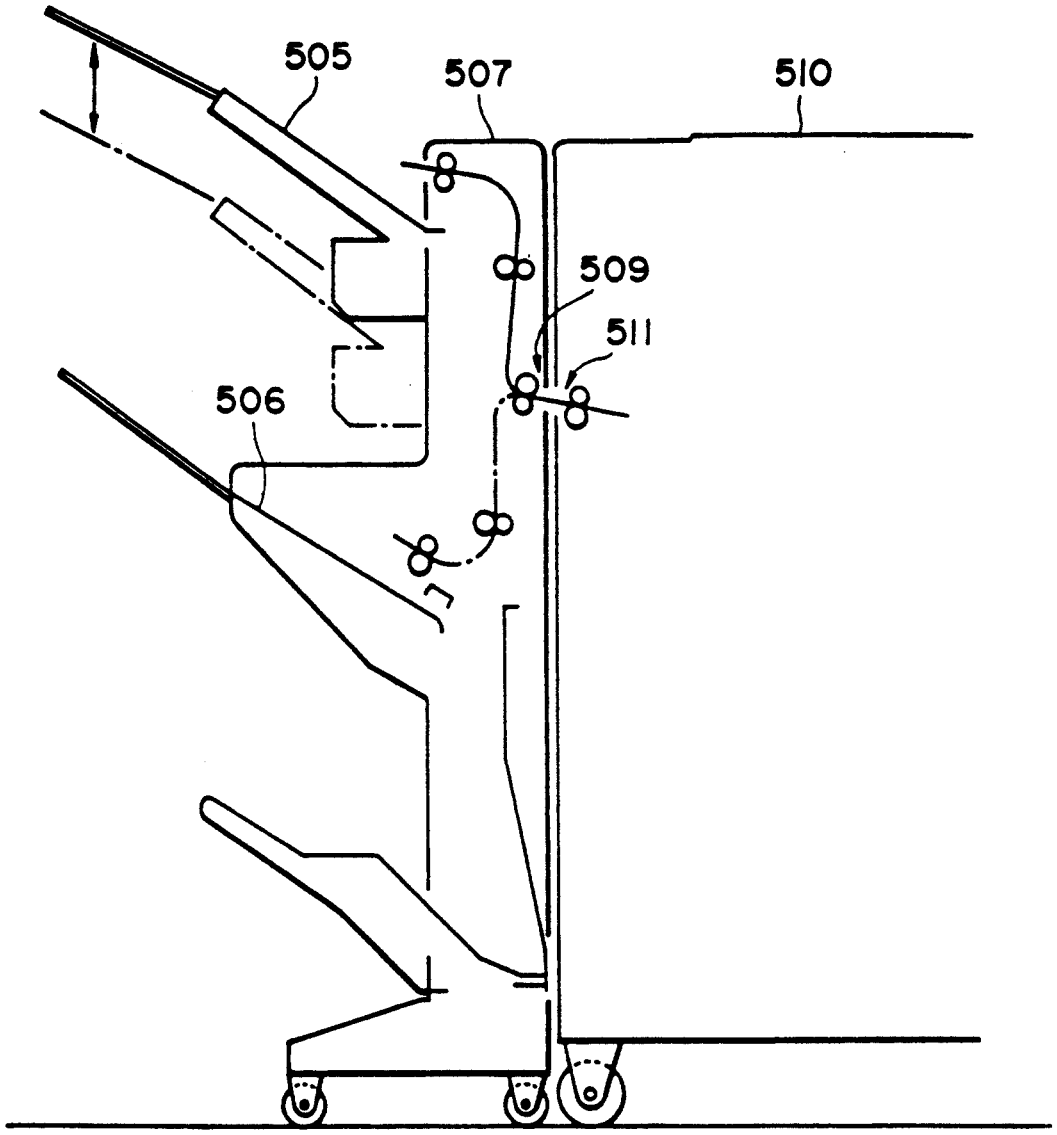
FIG. 9 is a partly sectional view of a finisher apparatus used with a copying apparatus.

FIG. 9 shows another embodiment wherein a classification tray apparatus is disposed at a stacker portion 505 of a finisher apparatus 507. The finisher apparatus 507 is disposed in series with a copying apparatus 510 in such manner that the sheet receiving inlet 509 of the finisher apparatus 507 is aligned with a sheet discharging outlet 511 of the copying apparatus 510, as shown in FIG. 9.

Figure 10:
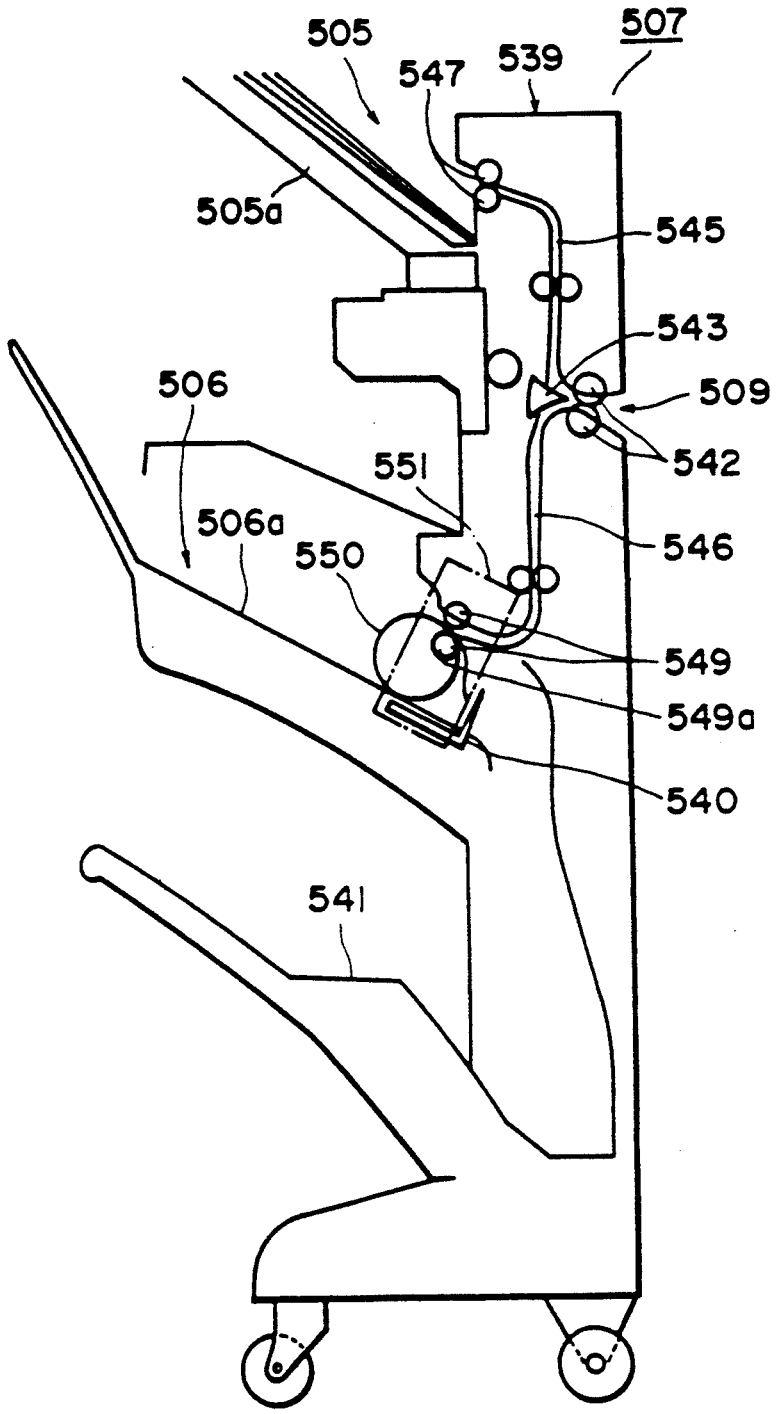
FIG. 10 is a sectional view of a finisher apparatus.

As shown in FIG. 10, the finisher apparatus 507 is provided with a sheet stacking tray 505 which constitutes the stacker portion 505 which is reciprocable in substantially the horizontal and vertical directions. The sheet stacking tray 505 is disposed at the upper rear part of the main frame 539 thereof. Below the stacker portion 505, an intermediate tray 506*a* constituting a stapling portion 506 is mounted to the frame 539 of the apparatus. To that end of the intermediate tray 506*a* which is near the main frame, a stopper 540 is rotatably mounted to bear one end of the sheet S on the tray 506*a*. Further, a lower tray 541 is mounted to the main frame 539 below the stapling portion 506. By rotation of the stopper 540, the sheet S or sheets S on the intermediate tray 506*a* fall on the lower tray 541 and are accommodated there. The upper front portion of the frame 539 of the finisher apparatus is provided with a sheet receiving inlet 509. The inlet 509 is located at substantially the same level as the sheet discharging outlet 511 of the copying apparatus 510. At the sheet receiving inlet 509, there is provided a receiving roller couple 542. Downstream of the receiving roller couple 542 with respect to movement of the sheet, an inlet deflector 543 is disposed which is effective to switch the direction of sheet transportation in two ways, that is, to selectively direct the sheet S from the sheet inlet 509 to a passage 545 leading to the stacker portion or to a passage 546 leading to the stapling portion. At the downstream end of the stacker passage 545, a discharging roller couple 547 is provided so as to discharge the sheet S to the sheet stacking tray 505*a*. At the downstream end of the stapling portion passage 546, there is a discharging couple of rollers 549 and 549*a*. Around a lower one 549*a* of the discharging 549 of rollers, a part of a belt 550 contacted to the intermediate tray 506*a* is trained, so that the belt 550 rotates together with the lower roller 549*a*, and the sheet S discharged onto the intermediate tray 506*a* is aligned along the stopper 540 at the edge thereof by the rotation of the discharging roller couple 549. Further, a stapler 551 is disposed above the lower part of the intermediate tray 506*a* and is effective to staple the sheets S on the intermediate tray 506*a*.

Figure 7:
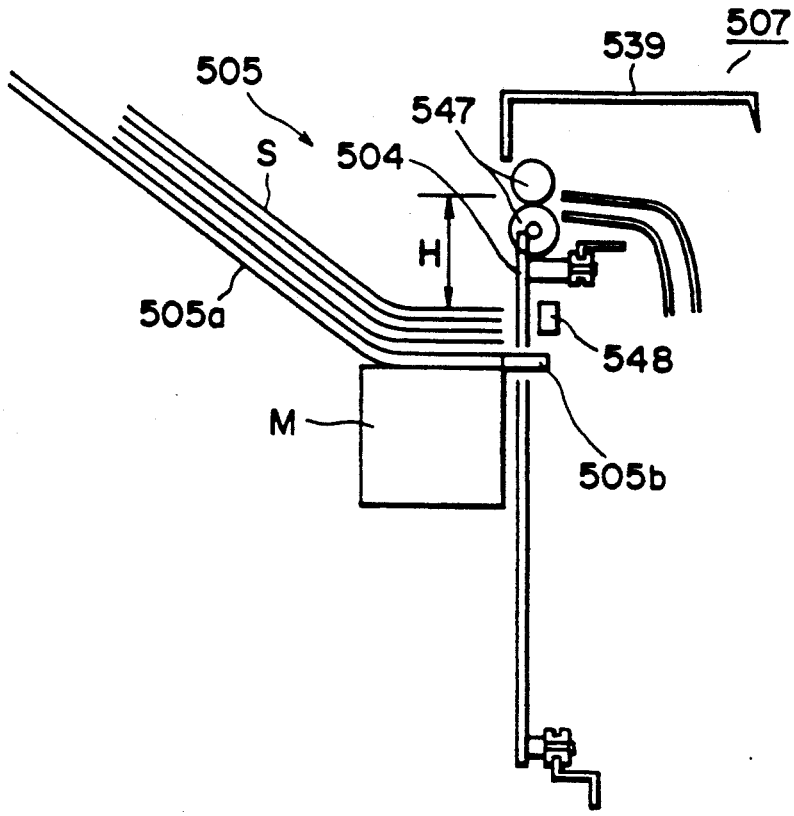
FIG. 7 is a sectional view of a tray apparatus according to another embodiment of the present invention.
Figure 8:
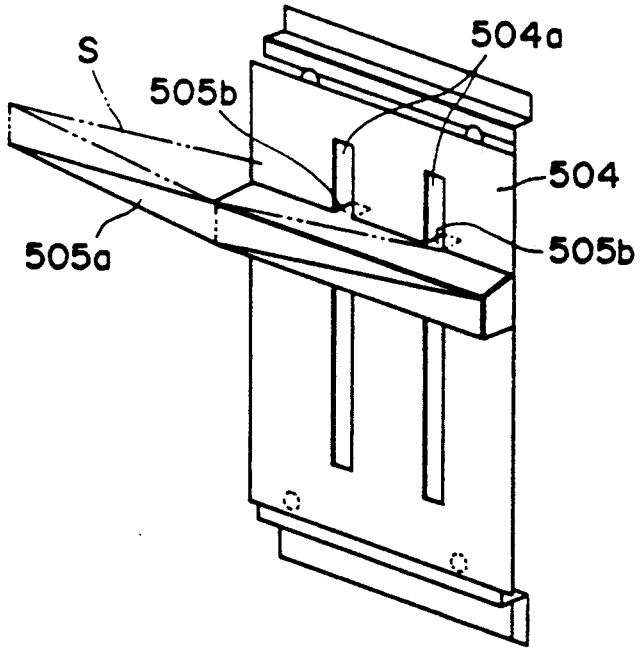
FIG. 8 is a perspective view of a tray and a sheet stopper of FIG. 7 embodiment.

As shown in FIGS. 7 and 8, the stacker portion 505 is equipped with a sheet end stopper 504 which is laterally movable in accordance with a signal produced in an unshown control station of the apparatus 539. The stopper 504 has two parallel slots 504*a* and 504*a* which extend substantially vertically. Into the slots 504*a* and 504*a*, two projections 505*b* formed at a lower end portion of the sheet stacking tray 505*a* are engaged, respectively. Because of this engagement, the sheet stacking tray 505*a* is movable substantially vertically by the sliding of the projections along 505*b* and 505*b* along the slots 504*a* and 504*a* and along the sheet stopper 504. The movement is controlled by a signal produced by a reflection type photosensor 548 which will be described hereinafter. Below the discharging roller couple 547 of the apparatus 539, a reflection type photosensor 548 is disposed facing the sheet stacking tray 505*a*. The sensor 548 produces a light signal and emits it to the sheets S stacked on the sheet stacking tray 505*a*, and it receives the light reflected by the sheets S.

In operation, the sheet S discharged from the outlet 511 of the copying apparatus 510, is conveyed by the rotation of the receiving roller couple 542 at the sheet inlet 509 to the inlet deflector 543. When the stacking mode is selected wherein the sheets S are stacked on the sheet stacking tray 505*a*, the inlet deflector 543 selects the passage to the stacker portion passage 545, whereby the sheet S is conveyed through the stacker portion passage 545, and discharged onto the sheet stacking tray 505*a* by the rotation of the discharging roller couple. The trailing edge of the sheet S stacked on the sheet stacking tray 505*a* receives the light signal produced by the reflection type photosensor 548 and reflects back it to the sensor 548, whereby the height of the stacked sheets S is detected. When the detected signal is such that the height H through which the sheet discharged by the discharging roller couple 547 falls on the topmost sheet S on the sheet stacking tray 505*a* is lower than the height with which the sheet S is received on the topmost sheet S in the aligned state, 40 mm for example, the sheet stacking tray 505*a* is driven by a lowering means M so that the stacking tray 505*a* with its projections 505*b* and 505*b* guided along slots 504*a* and 504*a* so as to maintain the falling height H. Each time an unshown copy start button of the copying machine 510 is actuated, the sheet stacking tray 505*a* laterally shifts together with the sheet stopper 504 with an increment of a few or several centimeters, whereby the sheets S stacked on the sheet stacking tray 505*a* are classified depending on the contents of the copy by the shifts of the discharged position on the tray. Therefore, the sheet or sheets are classified in response to the actuation of the copy switch. The height H may be controlled most severely for one sheet or may be more roughly controlled with the same degree of tolerance. The sheet stopper 504 is provided with rotatable rollers 520 and 521 at its upper and lower portions, the rollers 520 and 521 are guided by a fixed guide 523 and 524. The sheet stopper 504 is further provided with a rack gear meshed with a pinion of a motor, so that with rotation of the motor the sheet stopper 504 shifts laterally.

When the stapling mode is selected wherein the sheets S are stacked and then stapled, the inlet deflector 543 selects the passage leading to the stapling portion passage 546, so that the sheet S is conveyed through the passage 546. Then, the sheet S is discharged on the intermediate tray 506*a* by the rotation of the discharging roller couple 549 and the belt 550. The discharged sheet S is moved by the bottom portion of the belt 550 to the extent that the trailing edge of the sheet S is stopped by the stopper 540, and therefore, aligned along the stopper 540. When a desired number of the sheets S are stacked in the aligned state on the intermediate tray 506*a*, the edge thereof is stapled by the stapler 551. Then, the stopper 540 rotates to allow the stapled sheets S to fall to the bottom tray 541 and be accommodated there.

In order to keep the height H of the tray, another embodiment which will be described may be used.

A further embodiment will be described wherein the tray apparatus is provided in the stacker portion 605 of the finisher apparatus 607.

Figure 13:
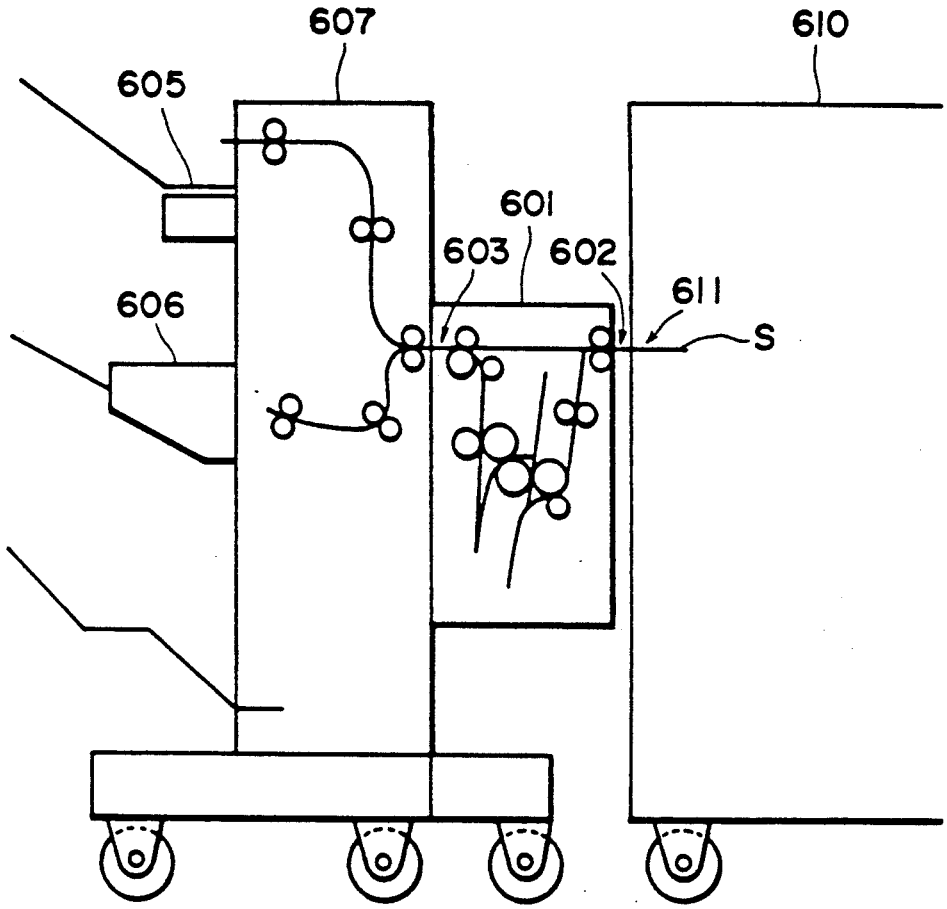
FIG. 13 is a somewhat schematic sectional view of a finisher apparatus and a sheet folding apparatus connected in series with a copying apparatus.

As shown in FIG. 13, when a sheet folding apparatus 601 and a finisher apparatus 607 are operatively coupled with and used with a copying apparatus 610, the finisher apparatus 607 is coupled with the sheet folding apparatus 601. The sheet discharging outlet 603 of the sheet folding apparatus 601 is aligned with the sheet receiving inlet 609 of the finisher apparatus 607, and the sheet discharging outlet 611 of the copying apparatus 610 is aligned with the sheet receiving inlet 602 of the sheet folding apparatus 601.

Figure 14:
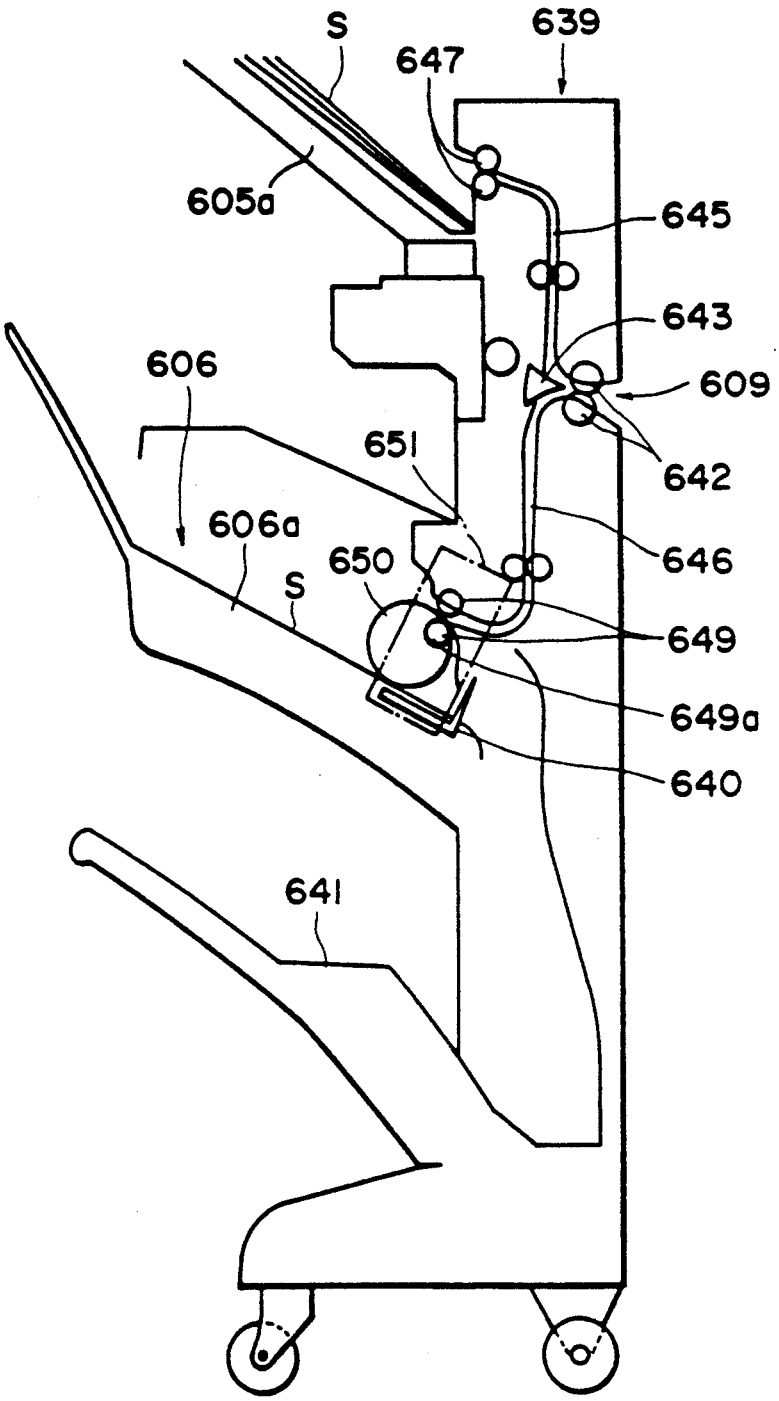
FIG. 14 is a sectional view of a finisher apparatus.

As shown in FIG. 14, the finisher apparatus 607 comprises a sheet stacking tray 605*a* at the upper portion of the apparatus 639. The sheet stacking tray 605*a* constitutes a stacker portion 605 and is reciprocally movable in substantially horizontal and vertical directions. The sheet stacking tray 605 inclines upwardly toward the outside. To the portion of the apparatus 639 below the stacker portion 609, an intermediate tray 606*a* constituting a stapling portion is mounted. The front end of the intermediate tray 606*a* which is near the apparatus 639, is provided with a sheet stopper 640 which is rotatable and effective to bear an edge of the sheet S on the tray 606*a*. There is a lower tray 641 mounted to the apparatus 639 below the stapling portion 606. When the stopper 640 rotates, the sheets S on the intermediate tray 606*a* falls to the lower tray 641. At the upper front portion of the finisher apparatus 639, there is a sheet receiving inlet 609 which is disposed at substantially the same level as the sheet discharging outlet 611 of the copying apparatus 610. In the sheet receiving inlet 609, a sheet receiving roller couple 642 is provided, and downstream thereof, there is an inlet deflector 643. The inlet deflector 643 serves to switch the direction of the sheet movement in two ways, more particularly, selectively to the stacker portion passage 645 or to the stapling portion passage 646.

At the downstream end portion of the stacker portion passage 645, there is a discharging roller couple 647 to discharge the conveyed sheets S to the sheet stacking tray 605*a*.

Figure 11:
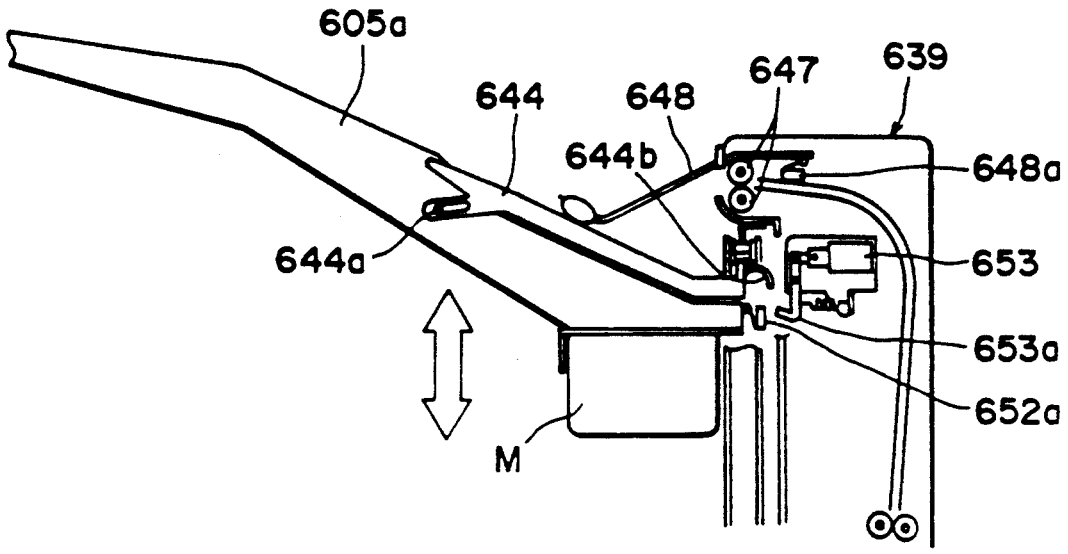
FIG. 11 is a sectional view of a tray apparatus according to a further embodiment of the present invention.
Figure 12:
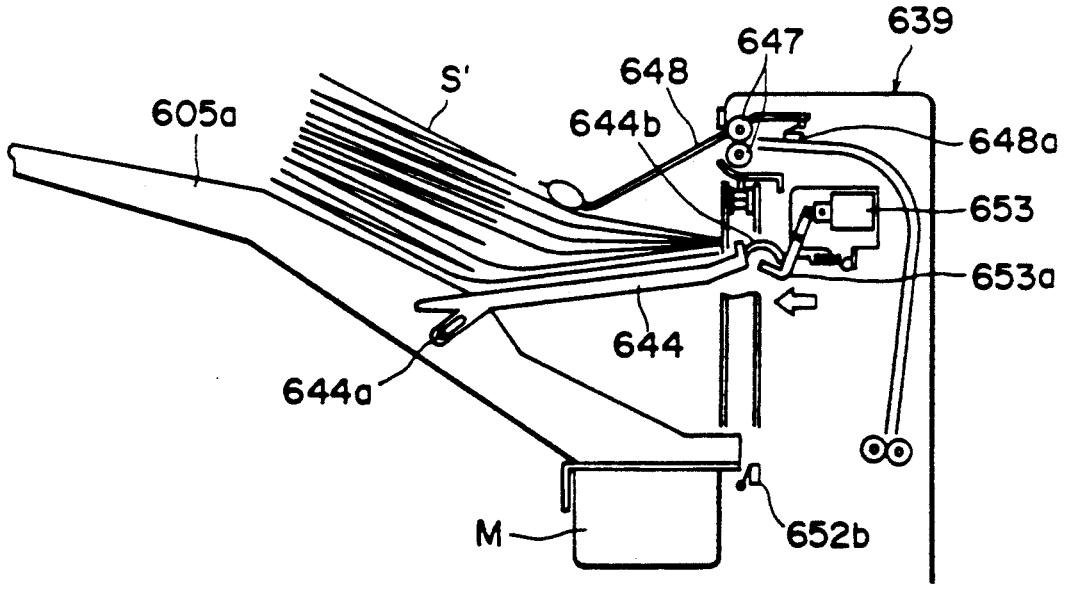
FIG. 12 is a sectional view of the FIG. 11 tray apparatus which stacks z-folded sheets.

As shown in FIGS. 11 and 12, to the apparatus 639 above the discharging roller couple 647, a sensor arm 648 is rotatably supported and is extended to the portion above the sheet stacking tray 605*a* so that it is pivotted in accordance with the stacking of the sheet S on the tray 605*a*. To the apparatus 639 adjacent the rear end of the sensor arm 648, there is a microswitch 648*a* for detecting the height of the stack. The switch 648*a* is actuated by the pivotting of the sensor arm 648, and in response to which the sheet stacking tray 605*a* is lowered. At an upper position, an upper limit microswitch 652*a* disposed, which is actuated when the sheet stacking tray 605*a* is moved upwardly to its upper limit so as to limit the upward movement of the sheet stacking tray 605*a*. Similarly, at the lower position, there is disposed a lower limit microswitch 652*b* so as to limit the downward movement of the sheet stacking tray 605*a*. An auxiliary sheet stacking plate 644 is provided so as to cover the portion of the upper surface of the tray 605*a* from its middle portion to the lower end portion. An end of the auxiliary plate adjacent the middle of the tray 605*a* is rotatably and slidably supported by hinge shafts 644*a* and 644*a*. At the lower end of the auxiliary plate 644, there is an engaging member 644*b*. At an upper of the apparatus 639 there is a plunger 653 for a z-folding operation. When the z-folded sheet S' is discharged onto the sheet stacking tray 605*a*, which is detected by a detecting means disposed in the conveying passage, or by the signal from a control circuit produced when the z-folding mode is selected, the plunger 653 is energized so that the arm 653*a* of the plunger 653 is engaged with the engaging member 644*b* of the auxiliary sheet stacking plate 644.

Adjacent a downstream end of the stapling portion passage 646, there is a discharging roller couple 649. Around a lower roller 649*a* of the discharging roller couple 649 of rollers, a part of a belt 650 contacted to the intermediate tray 606*a* is trained, so that the belt 650 rotates together with the lower roller 649*a*, and the sheet S discharged onto the intermediate tray 606*a* is aligned along the stopper 640 at the edge thereof by the rotation of the discharging roller couple 649. Further, a stapler 651 is disposed above the lower part of the intermediate tray 606*a* and is effective to staple the sheets S on the intermediate tray 606*a*.

Figure 15:
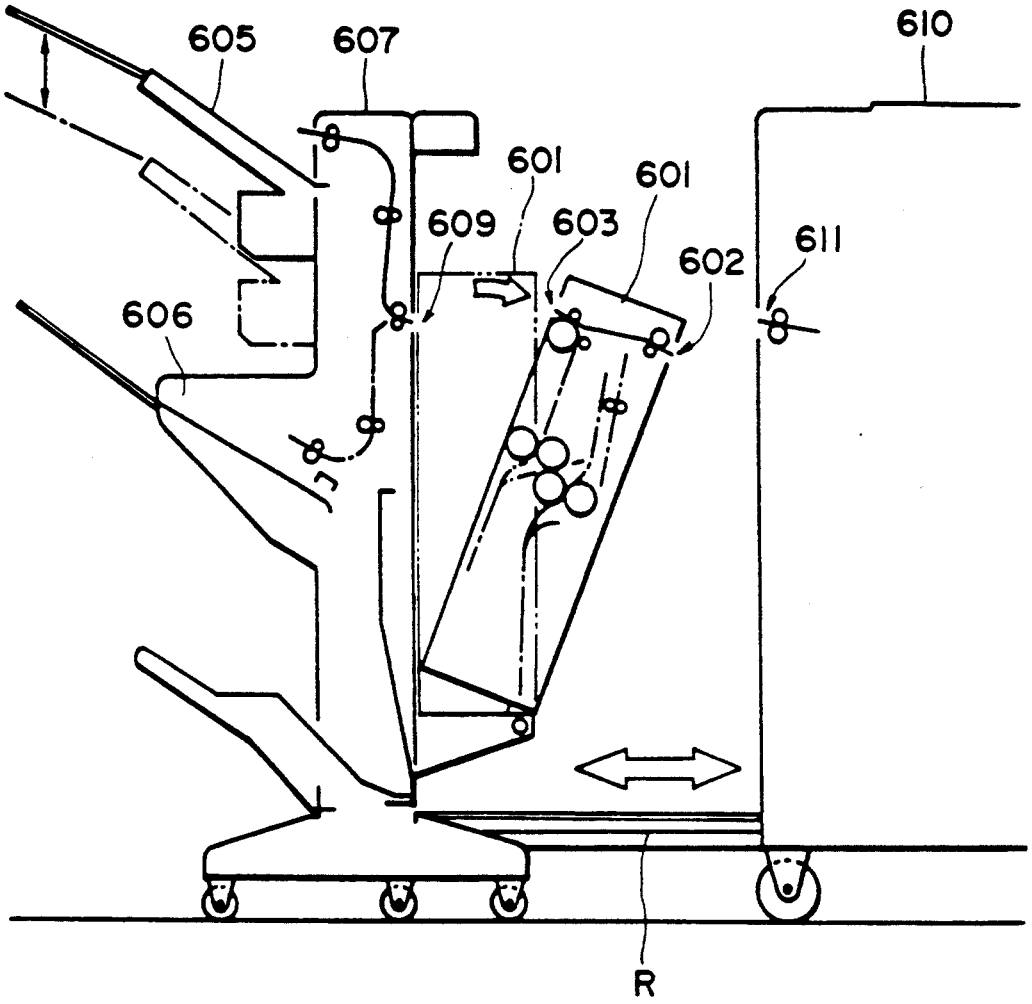
FIG. 15 is a sectional view of the finisher apparatus and the folding apparatus connected in series with a copying apparatus wherein the manner of connection therebetween is illustrated.

As shown in FIG. 15, since the apparatus according to this embodiment has the structure described above, when the folding apparatus 601 is operatively coupled with the copying apparatus 610, and a finisher apparatus 607 is coupled with the sheet folding apparatus 601, the finisher apparatus 607 is rotatably supported on the sheet folding apparatus 601, and the finisher apparatus 607 is disposed in series with the copying apparatus 610 along a rail R in the manner that the sheet discharging outlet 611 of the copying apparatus 610 is aligned with the sheet receiving inlet of the folding apparatus 601.

The sheet S discharged from the outlet 611 of the copying apparatus 610 is conveyed from the sheet receiving inlet 602 of the folding apparatus 601 into the folding apparatus 601. When a z-folding mode is selected wherein the sheet S is z-folded, the sheet S is z-folded in the folding apparatus 601 into a z-folded sheet S' and then is discharged through the sheet discharging outlet 603. The z-folded sheet S' thus folded and discharged through the outlet 603, is conveyed from the sheet inlet 609 of the finisher apparatus 607 to the inlet deflector 643 by the rotation of the receiving roller couple 642. When a stacking mode is selected wherein the z-folded sheet S' is stacked on the sheet stacking tray 605*a*, the inlet deflector 643 is switched to the stacking portion passage 645. Then, the z-folded sheet S' is conveyed through the stacking portion passage 645 and is discharged onto the sheet stacking tray 605*a* by the rotation of the discharging roller couple 647. When the z-folded sheet S' is discharged onto the sheet stacking tray 605*a*, the plunger 653 is actuated so that the arm 653*a* of the plunger 653 is engaged with the engaging member 644*b* of the auxiliary sheet stacking plate 644. When the z-folded sheet S' is stacked on the sheet stacking tray 605*a*, the sensor arm 648 is rotated in accordance with the increment of the stack of the sheet S', and the height microswitch 648*a* is actuated. Further, when the microswitch 648*a* is actuated, the sheet stacking tray 605*a* is lowered until the switch 648*a* is diactivated. At this occasion, together with the lowering of the sheet stacking tray 605*a*, the auxiliary sheet stacking plate 644 is inclined in the opposite direction to the upward inclination of the sheet stacking tray 605*a*, as shown in FIG. 12. The bulky portion of the stack which is caused by the three times thickness of the sheet due to the z-folding is suppressed by the inclination of the auxiliary plate 644 and by the pressing action of the sensor arm 648, with the result that a number of z-folded sheet S' are stably supported on the surface provided by the sheet stacking tray 605*a* and the auxiliary sheet stacking plate 644. It should be noted that because of the cooperation of the sheet stacking tray 605*a* and the auxiliary plate 644, the stack of the sheet S' is maintained substantially horizontal, and the discharged sheet S' does not interfere with the stacked sheets. Therefore, it is not always necessary that the arm 648 presses the stack of the sheet. When the sheet stacking tray 605*a* lowers to such an extent that the lower limit microswitch 652*b* is actuated, the lowering movement of the sheet stacking tray 605*a* stops. After the copying operation is completed, and the stack of the sheet is removed from the sheet stacking tray 605*a*, the arm 648 rotates counterclockwisely, as seen in this Figure, so as to diactivate the switch 648*a*, thus allowing the sheet stacking tray 605*a* move upwardly. When it contacts to the upper limit microswitch 652*a* and actuates it, the sheet stacking tray 605*a* is stopped at a predetermined position. If necessary, the sheet stacking tray 605*a* may be moved horizontally, whereby the discharged sheets are classified and stacked.

When the stapling mode is selected wherein the sheets are stacked and then stapled, the inlet deflector 643 selects the staple portion passage 646 so as to direct the sheet S to the stapling portion passage 646. The sheet S is discharged onto the intermediate tray 606*a* by the rotation of the roller couple 649 and the belt 650. The discharged sheet S is moved backwardly by the bottom part of the rotation belt 650 so that the trailing edges of the sheets S are aligned along the stopper 640. When a desired number of sheets S are stacked and aligned on the intermediate tray 606*a*, end portion thereof is stapled by the stapler 651. Then, the stopper 640 rotates to allow the stapled sheets S to fall on the lower tray 641.

In the description of the foregoing embodiments, the sheet stacking tray 605*a* receives z-fold sheets S'. When, however, the sheet S is reversely z-folded, the sheets can be stably supported to some extent without the use of the auxiliary plate 644. However, the stability is not higher than the case where the auxiliary sheet stacking plate 644 is used, and therefore, it is desirable to employ the auxiliary sheet stacking plate 644 as described above.

In the description of the foregoing embodiment, when the sheet stacking tray 605*a* receives the z-folded sheet S', the lower end portion of the auxiliary sheet stacking plate 605*a* is engaged with the finisher apparatus 639 and the auxiliary plate 605*a* is inclined in accordance with the lowering of the sheet stacking tray 605*a*. However, this is not limiting. As an example of an alternative, a detecting means for detecting the flatness of the sheet stacked on the sheet stacking tray 605*a* is employed together with a servo motor operatively connected to the auxiliary sheet stacking plate 644, whereby the servo motor is driven in response to the detection of the detecting means so as to control the inclination of the auxiliary sheet stacking plate 644.

While the invention has been described with reference to the structures disclosed herein, it is not confined to the details set forth and this application is intended to cover such modifications or changes as may come within the purpose of the improvements or the scope of the following claims.

What is claimed is:

1. A tray apparatus, comprising:

a stacking tray for stacking discharged sheet materials;

a sheet end stopper for stopping an end edge of the sheet material discharged to said tray to align the sheet materials, said end stopper being movable in a lateral direction with respect to a direction of sheet discharge;

supporting means for supporting the tray so that the tray is movable substantially vertically relative to said end stopper and is movable laterally together with said end stopper;

first control means for controlling downward movement of said tray in accordance with an amount of sheet materials on said tray; and second control means for controlling lateral movement of said end stopper and said tray in accordance with a sorting signal to sort said sheet materials.

2. An apparatus according to claim 1, wherein said support means is in the form of a guiding groove.

3. A tray apparatus, comprising:

a tray for stacking discharged sheets on its sheet stacking surface;

a regulating member for regulating positions of edges of sheets stacked on said tray, said regulating member provided with vertical grooves;

a projection member integral with said tray, engageable with said grooves and having a surface connecting with the sheet stacking surface of said tray; and moving means for moving up and down said tray with said projection member engaged with the grooves.

4. An apparatus according to claim 3, further comprising detecting means for detecting an amount of the sheets stacked on said tray, and wherein said moving means is responsive to an output of said detecting means.

5. An apparatus according to claim 3, wherein said regulating member is abutted by upstream edges of the sheets.

6. A finisher apparatus, comprising:

a sheet discharge means;

a stacking tray for stacking discharged sheet materials;

a sheet end stopper for stopping an end edge of the sheet material discharged to said tray to align the sheet materials, said end stopper being movable in a lateral direction with respect to a direction of sheet discharge;

a supporting means for supporting the tray so that said tray is movable substantially vertically relative to said end stopper and is movable laterally together with said end stopper;

first control means for controlling downward movement of said tray in accordance with an amount of the sheet materials on said tray; and second control means for controlling lateral movement of said end stopper and said tray in accordance with a sorting signal to sort said sheet materials.

7. A finisher apparatus, comprising:

a sheet discharge means;

a tray for stacking discharged sheets on its sheet stacking surface;

a regulating member for regulating positions of edges of sheets stacked on said tray, said regulating member provided with vertical grooves;

a projection member integral with said tray, engageable with said grooves and having a surface connecting with the sheet stacking surface of said tray; and moving means for moving up and down said tray with said projection member engaged with the grooves.

* * * * *

UNITED STATES PATENT AND TRADEMARK OFFICE

CERTIFICATE OF CORRECTION

PATENT NO. : 5,316,287
DATED : May 31, 1994
INVENTOR(S) : MASAKAZU HIROI, ET AL.

It is certified that error appears in the above-indentified patent and that said Letters Patent is hereby corrected as shown below:

Column [56] RC,
line FPD, "1248845 10/1989 Japan" should read --1-248845 10/1989 Japan--.

Column 1,
line 6, "which" should read --which is a continuation--.

Column 3,
line 62, "is" should read --are--.

Column 4,
line 63, "and" should read --and additionally,--.

Column 5,
line 29, "104" should be deleted;
line 30, "and" should be deleted; and
line 42, "an" should be deleted.

Column 7,
line 53, "back it" should read --it back--.

UNITED STATES PATENT AND TRADEMARK OFFICE

CERTIFICATE OF CORRECTION

PATENT NO. : 5,316,287

DATED : May 31, 1994

INVENTOR(S) : MASAKAZU HIROI, ET AL.

It is certified that error appears in the above-indentified patent and that said Letters Patent is hereby corrected as shown below:

Column 9,
line 30, "upper" should read --upper portion--.

Column 10,
line 23, "diactivated." should read --deactivated.--;
line 46, "diac-" should read --deac- --;
line 60, "of the" should read --of the discharging--; and
line 65, "end" should read --the end--.

Column 11,
line 52, "support" should read --supporting--.

Signed and Sealed this

Fifteenth Day of November, 1994

Bruce Lehman

*Attest:*

BRUCE LEHMAN

*Attesting Officer*

*Commissioner of Patents and Trademarks*